United States Patent [19]

Ewald

[11] Patent Number: 4,525,271

[45] Date of Patent: Jun. 25, 1985

[54] SCREENING APPARATUS FOR GRAINS, SEEDS OR THE LIKE MATERIALS OR GRANULES

[75] Inventor: Ole Ewald, Odense, Denmark

[73] Assignee: Damas Maskinfabrik A/S, Faaborg, Denmark

[21] Appl. No.: 574,515

[22] Filed: Jan. 27, 1984

[30] Foreign Application Priority Data

Feb. 3, 1983 [DK] Denmark ..... 446/83

[51] Int. Cl.[3] ..... B07B 1/26

[52] U.S. Cl. ..... 209/303; 209/369

[58] Field of Search ..... 209/303, 304, 369, 288, 209/289, 237

[56] References Cited

U.S. PATENT DOCUMENTS

| | | | |
|---|---|---|---|
| 857,942 | 6/1907 | Howard | 209/237 |
| 2,682,812 | 7/1954 | Mathewson | 209/303 |
| 2,822,127 | 2/1958 | Sinn | 209/304 |
| 3,767,047 | 10/1973 | Rasmussen | 209/303 |

FOREIGN PATENT DOCUMENTS

| | | | |
|---|---|---|---|
| 654063 | 10/1958 | Canada | 209/304 |
| 122791 | 4/1972 | Denmark . | |
| 173214 | 6/1905 | Fed. Rep. of Germany | 209/303 |
| 782891 | 11/1980 | U.S.S.R. | 209/304 |

*Primary Examiner*—Tim Miles

*Attorney, Agent, or Firm*—Watson, Cole, Grindle & Watson

[57] ABSTRACT

A screening apparatus for granules or the like material comprises a housing, wherein a frame structure is arranged which is rotatable about a main axis. The frame structure supports a screen drum which is rotatable by means of a shaft arranged eccentrically with respect to the main axis. In order to readjust the screening apparatus from screening one material and to screen another material which needs another contribution of the centrifugal force from the planetary movement of the screen drum, the eccentrically of the screen drum with respect to the main axis is variable.

6 Claims, 2 Drawing Figures

SCREENING APPARATUS FOR GRAINS, SEEDS OR THE LIKE MATERIALS OR GRANULES

BACKGROUND OF THE INVENTION

The present invention relates to a screening apparatus for grains, seeds or the like materials or granules, comprising a housing wherein a frame structure is arranged which is adapted to be rotated about a main axis and to support screening means eccentrically arranged with respect to the main axis.

An apparatus of the kind referred to above is disclosed in Danish Pat. No. 122,791. The screening means of this known apparatus consist of two screen drums arranged diametrically with respect to the main axis. During the operation of this known screening apparatus, the frame structure and, accordingly, also the screen drums, are driven in a planetary movement about the main axis and simultaneously each of the screen drums performs a rotating movement about its own axis which, accordingly, constitutes a planetary axis. Accordingly, the material which is fed into the screen drums will be subjected to a centrifugal force which partly is due to the rotation of the screen drums themselves, and partly is due to the planetary movement of the screen drums. Such centrifugal force results in that a body of material having a cross section shape generally corresponding to a kidney will adjust itself along the parts of the screen drums which, at any time, face outwardly and such body of material will, provided the peripheral velocities of the drums and the peripheral velocity of the planetary movement are selected appropriately with respect to the material to be screened, move comparatively slowly down through the corresponding drum, and simultaneously the material constituting the body will be tumbled around upon the inner surfaces of the screen means, whereby the desired screening effect is achieved.

Moreover, reference is made to the present inventor's U.S. Pat. No. 4,480,754 in which a screening apparatus is disclosed wherein the eccentricity of the axis of rotation of a screen drum is smaller than the longest radius of the screen drum.

SUMMARY OF THE INVENTION

According to the present invention the eccentricity of the screening means is variable. By means of such screening apparatus it is possible, under otherwise equal conditions, to change the contribution of the centrifugal force upon the material which is due to the planetary movement of the screening means, and accordingly the screening apparatus may in a very simple way be adapted to the material to be screened. According to a preferred embodiment of the invention the eccentricity of the screening means is variable between a value greater than the longest radius of the screening means and a value approximately equal to nil. With such an embodiment the contribution of centrifugal force due to the planetary movement may be varied within a very broad range in such a way that the apparatus also will be able to treat a correspondingly wide range of materials.

In order to obtain the variable eccentricity of the screening means, the screening means according to a further embodiment of the invention may be eccentricity mounted in a support structure, which is rotatably supported by the frame structure about an axis which is eccentrically arranged with respect to the main axis, and wherein the support structure, moreover, is securable in different positions of rotation.

According to a further embodiment of the invention, the axis of rotation of the support structure may have an eccentricity with respect to the main axis generally corresponding to the eccentricity of the screening means with respect to the axis of rotation of the support structure. With such an embodiment the eccentricity of the screening means with respect to the main axis may be readjusted from a maximum value and to approximately nil, viz. merely by rotating the support structure approximately 180°.

According to a further embodiment of the screening apparatus according to the present invention, the movement of rotation of the screening means may be transferred via an intermediate shaft arranged coaxially with repect to the axis of rotation of the support structure. This embodiment results in a simple construction of the apparatus because the rotation of the support structure will be without influence upon the transfer of the movement.

In order to achieve an appropriate static balance of the apparatus according to the invention, the support structure may support a counterweight so as to balance the screening means with respect to the axis of rotation of the support structure and, moreover, the support frame may support a counterweight balancing the support structure and the parts supported by the support structure with respect to the main axis.

DESCRIPTION OF THE PREFERRED EMBODIMENT

Figure 1:
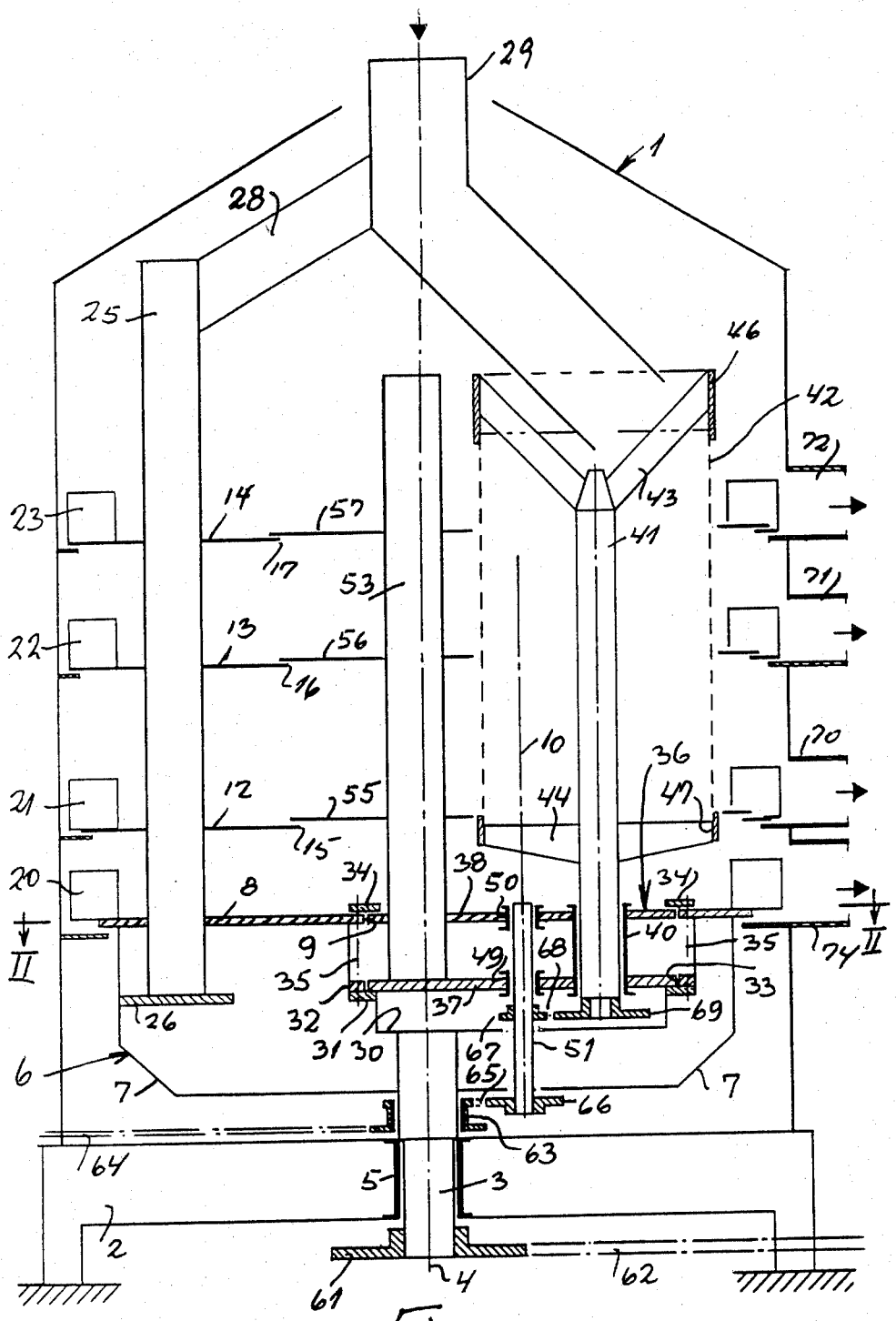
FIG. 1 shows schematically a vertical central section of an embodiment of the screening apparatus according to the invention.

In the drawing, 1 is a housing supported by a bottom frame 2. In the bottom frame a main shaft 3 is mounted, the axis of which is designated 4. The shaft 3 is mounted in a bearing 5 serving both as a radial and as a thrust bearing. The main shaft 3 supports a frame structure generally designated 6. The frame structure comprises a number of vertically arranged plates 7 extending in pairs diagonally outwardly from the main shaft 3 to which the inner ends of the plates are secured by welding. For the sake of clarity only one pair of such plates 7 is illustrated, viz. the plates which are positioned approximately in the drawing plane of FIG. 1. Along their upper edges the plates 7 support an outwardly circular bottom wall 8, wherein an opening 9 is provided eccentrically with respect to the main axis 4. The axis of the opening 9 is designated 10. Moreover, the frame structure 6 comprises outwardly circular intermediate walls 12,13 and 14, in each of which a circular eccentrically arranged opening is provided, the edges of which is designated 15,16 and 17, respectively. The centres of these openings are positioned along the same axis 10 as the centre of the opening 9. Along the peripheries, the bottom wall 8 and the intermediate walls 12,13 and 14 support vanes 20, 21, 22 and 23, respectively, which are equally distributed along the circumferences of the corresponding walls. The frame structure 6, moreover, comprises a main counterweight 25 supported by means of the plates 7, between which a bracket 26 is arranged and by means of the bottom wall 8. At its upper end the main counterweight 25 is secured to a bracket 28 which at its other end supports a feeding tube 29. The main counterweight 25 extends through holes in the intermediate walls 12, 13 and 14, and the edges of these holes are secured to the main counterweight 25.

In each pair of diametrically extending plates 7, a recess 30 is provided and upon shoulders provided along the side edges of the recesses 30, a clamping rim 31 is secured coaxially with the axis 10. To the upper surface of the clamping rim 31 a circular guiding rim 32 is secured, having an internal diameter a little greater than the internal diameter of the clamping rim 31 so as to provide a circumferentially extending recess 33. Upon the upper surface of the bottom wall 8, a further clamping rim 34 is arranged, having an internal diameter which is a little smaller than the diameter of the opening 9 and an external diameter which is a little greater than the diameter of the opening 9. Through holes in the two clamping rims 31 and 34 and through holes in the guiding rim 32, tensioning bolts 35 extend which also pass through holes in the bottom wall 8 adjacent the edge of the opening 9.

The recess 33 together with the opening 9 in the bottom wall 8 serve to accommodate a support structure 36, comprising two circular discs 37 and 38, rigidly connected to each other. The circumference of the disc 37 extends coaxially with the guiding rim 32 and the circumference of the circular disc 38 extends coaxially with the edge of the opening 9 in the bottom wall 8. Accordingly, it will be understood that the centres of the two discs 37 and 38 are positioned along the axis 10. The two discs 37 and 38 support a schematically illustrated bearing 40 for the shaft 41 for a screen drum 42, and moreover the discs 37 and 38 are arranged with a mutual distance which is a little greater than the distance between the bottom wall 8 and the clamping rim 31. The screen drum 42 is schematically illustrated in the drawing, but it will be understood that the drum 42 comprises screening means in the form of one, two or more screens, arranged coaxially with respect to the shaft 41 and supported by the shaft 41 by means of arms 43 at the upper end of the shaft 41 and by arms 44 at the lower ends of the screening means. At the top and at the bottom the screen drum 42 terminates in a cylindrical walls 46 and 47, respectively.

Moreover, each of the discs 37 and 38 is, at the centre, provided with a bearing 49 and 50, respectively, for an intermediate shaft 51, the axis of which, accordingly, extends coaxially with the axis 10. Moreover, the support structure 36 supports a counterweight 53 for balancing the screen drum with respect to the axis 10. Accordingly, the counterweight 53 has such a weight and is arranged at such distance from the axis 10 that the weight multiplied by distance generally equals the weight of the drum multiplied by the centre distance of the drum from the axis 10. Moreover, the counterweight 53, the axis 10 and the shaft 41 are arranged in the same perpendicular plane. Furthermore, the support structure 36 supports, by means of the counterweight 53 and further structural parts (not shown for the sake of clarity), circular discs 55, 56 and 57 having external diameters a little greater than the openings in the intermediate walls 12, 13 and 14 defined by the edges 15, 16 and 17. In the discs 55, 56 and 57 holes are provided through which the drum extends with a small clearance.

From the explanations given above it will be understood that the whole structure constituted by the support structure 36 and the parts supported thereby, viz. the screen drum, the counterweight 53 and the discs 55, 56 and 57 may be rotated about the axis 10, viz. by loosening the bolts 35, whereby the edges of the two discs 37 and 38 are released in such a way that the support structure 36 may be rotated and then the support structure may again be secured, viz. by clamping the clamping rims 31 and 34 towards each other by means of the bolts 35. By such clamping the edges of the discs 37 and 38 are clamped with respect to the plates 7 and the bottom wall 8. In FIG. 1, the drum 42 is shown positioned with its shaft 41 at the maximum distance from the main axis 4. However, it will be understood that by a rotation as explained above, the shaft 41 will move along an arch, the centre of which is defined by the axis 10, and the radius of which is defined by the eccentricity of the shaft 41 with respect to the axis 10. Accordingly, by such rotation the shaft 41 will be moved towards the main axis 4 in such a way that the radius of the planetary path of the screen drum is reduced. The feeding tube 29 is provided with a hinge (not shown) and is telescopically so as to be readjustable corresponding to the drum 42.

Figure 2:
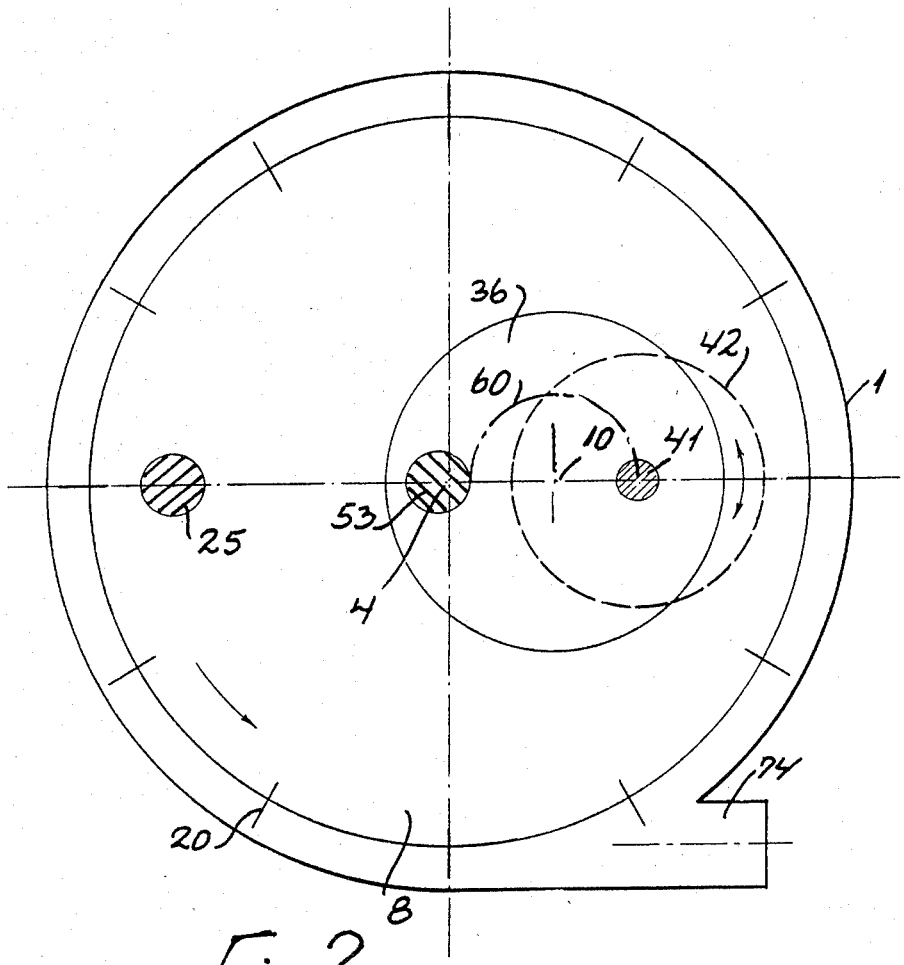
FIG. 2 shows more schematically a cross section according to section line II—II in FIG. 1.

The adjusting movement of the drum shaft 41 is indicated in FIG. 2 by means of circular arch 60 shown in broken line.

No matter what position of rotation the support structure 36 occupies, the centre of gravity of the support structure and the parts supported thereby will be positioned along the axis 10. The weight of the counterweight 25 and its distance from the main axis 4 are selected in such a way that the weight multiplied by the distance generally equals to the weight of the support structure 36 and the parts supported thereby multiplied by the distance between the axes 4 and 10 in such a way that also the frame structure 6 is statically balanced.

For driving the screening apparatus shown, a sprocket 61 meshing with a chain 62 driven by a motor (not shown) is secured to the lower end of the main shaft 3 which projects from the bearing 5. Moreover, about the main shaft 3 and above the bottom frame 2 and below the plates 7, a set of sprockets 63 is mounted, one of which is driven by means of a chain 64, driven by means of a motor (not shown) and the other of which by means of a chain 65 is connected with a sprocket 66, secured to the lower end of the intermediate shaft 51 which projects downwardly below the plates 7. Within the recesses 30 in the plates 7, the intermediate shaft 51 carries a sprocket 67 which by means of a chain 68 is connected with a sprocket 69, secured to the lower end of the shaft 41 of the drum, projecting down below the support structure 36.

The screening apparatus shown operates in the following way:

By means of the chain 62 and the sprocket 61 the main shaft 3 is rotated in the bearing 5 and, accordingly, the frame structure 6 is rotated about the main axis 4. By means of the chain 64 and the sprocket-chain structure 63, 65, 66, 67, 68 and 69, the screen drum 42 is rotated about the shaft 41. Accordingly, the screening means are subjected to both a rotational movement about the axis of the shaft 41 and a planetary movement about the main axis. The material to be screened is supplied through the feeding tube 29 and will move down through the screen drum and during this movement screening will occur outwardly through the screening means and above the intermediate discs 57, 56 and 55, respectively. The vanes 23, 22 and 21 carried by the walls 14, 13 and 12, respectively, will serve to dispense the corresponding screening fractions through housing outlets 72, 71 and 70, respectively, which in FIG. 1 are shown as being oriented radially, but which actually extend generally tangentially with respect to the housing 1. The material unable to pass out through the screening means continues through the interior of the drum and to the bottom wall 8, at which such material is dispensed by means of the vanes 20 through an outlet 74. Also this outlet is tangentially oriented as it appears from FIG. 2 as are the other outlets 70, 71 and 72.

According to the embodiment shown in the drawing, the eccentricity of the shaft 41 with respect to the axis 10 is selected generally equal to the eccentricity between the main axis 4 and the axis 10. The result is that the screen drum, by rotation of the support structure 36 through approximately 180° with respect to the position illustrated in FIG. 1, may be positioned so as to extend generally coaxially with the main axis 4, whereby the contribution to the centrifugal force applied to the material and which results from the planetary movement may be reduced approximately to nil. According to the embodiment shown in the drawing, the sum of the two eccentricities is a little longer than the maximum radius of the drum, which means that the drum, in the position wherein the shaft of the drum occupies the longest distance from the main axis, will rotate without extending into the main axis. According to such embodiment, only one screen drum may be arranged at the same level in the apparatus. However, if the sum of the eccentricities mentioned is selected much longer than the drum diameter, two drums may be arranged at the same level in the apparatus.

I claim:

1. Screening apparatus for grains, seeds or the like material or granules, comprising a housing wherein a frame structure is arranged which is adapted to be rotated about a main axis and supports rotatable screening means eccentrically arranged with respect to said axis, and means to vary the eccentricity of said screening means with respect to said axis.

2. Screening apparatus according to claim 1, wherein the eccentricity of the screening means is variable between a value greater than the longest radius of the screening means and a value approximately equal to nil.

3. Screening apparatus according to claim 1, wherein the screening means are eccentrically mounted in a support structure, the support structure being rotatably supported by the frame structure about an axis which is eccentrically arranged with respect to the main axis, the support structure moreover being securable in different positions of rotation.

4. Screening apparatus according to claim 3, wherein the axis of rotation of the support structure has an eccentricity with respect to the main axis generally corresponding to the eccentricity of the screening means with respect to the axis of rotation of the support structure.

5. Screening apparatus according to claim, 3, wherein the movement of rotation of the screening means is transferred via an intermediate shaft arranged coaxially with respect to the axis of rotation of the support structure.

6. Screening apparatus according to claim 3, wherein a counterweight is supported by the support structure so as to balance the screening means with respect to the axis of rotation of the support structure, the support frame moreover supporting a counterweight balancing the support structure and the parts supported by the support structure with respect to the main axis.

* * * * *